US006952548B2

(12) United States Patent
Uchida et al.

(10) Patent No.: US 6,952,548 B2
(45) Date of Patent: Oct. 4, 2005

(54) CHARGING APPARATUS WITH AUXILIARY MEMBER AND IMAGE FORMING APPARATUS HAVING THE CHARGING APPARATUS

(75) Inventors: Michio Uchida, Shizuoka (JP); Akihiko Takeuchi, Shizuoka (JP); Tomoyuki Araki, Shizuoka (JP); Tamotsu Kaneko, Shizuoka (JP); Takaaki Tsuruya, Shizuoka (JP); Isao Matsuoka, Shizuoka (JP); Hirotaka Ishii, Shizuoka (JP); Tomonori Shida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 12 days.

(21) Appl. No.: 10/448,397

(22) Filed: May 30, 2003

(65) Prior Publication Data

US 2004/0042820 A1 Mar. 4, 2004

(30) Foreign Application Priority Data

May 31, 2002 (JP) ..... 2002/160125
May 31, 2002 (JP) ..... 2002/160126

(51) Int. Cl.[7] ..... G03G 15/02
(52) U.S. Cl. ..... 399/173; 250/324
(58) Field of Search ..... 399/168–173; 250/324–326; 361/230

(56) References Cited

U.S. PATENT DOCUMENTS 3,792,312 A * 2/1974 Marx ..... 361/230
5,154,411 A 10/1992 Saito et al. ..... 271/289
5,177,549 A 1/1993 Ohtsuka et al.
5,179,397 A 1/1993 Ohzeki et al. ..... 346/160
5,192,977 A 3/1993 Kaneko et al.
5,196,885 A 3/1993 Takeuchi et al.
5,229,819 A * 7/1993 Beresniewicz et al. ..... 399/172
5,666,605 A * 9/1997 Tokimatsu et al. ..... 399/173
5,899,610 A 5/1999 Enomoto et al. ..... 399/302
6,011,936 A 1/2000 Kaneko ..... 399/21
6,097,919 A 8/2000 Takeuchi et al. ..... 399/298
6,151,476 A 11/2000 Tsuruya et al. ..... 399/302
6,151,477 A 11/2000 Takeuchi et al. ..... 399/318
6,175,702 B1 1/2001 Takeuchi et al. ..... 399/101
6,185,397 B1 * 2/2001 Kumar et al. ..... 399/173
6,382,614 B1 5/2002 Fukatsu et al. ..... 270/58.11
6,385,428 B1 5/2002 Uchida et al. ..... 399/303
6,459,870 B1 * 10/2002 Lee ..... 250/324
6,493,529 B1 * 12/2002 Umemura et al. ..... 399/168
2003/0007810 A1 1/2003 Enomoto et al. ..... 399/302
2003/0053814 A1 3/2003 Suzuki et al. ..... 399/69

* cited by examiner

*Primary Examiner*—William J. Royer
(74) *Attorney, Agent, or Firm*—Fitzpatrick, Cella, Harper & Scinto

(57) ABSTRACT

A charging apparatus has a discharging member with a plurality of protrusions and an auxiliary member for assisting discharges by the discharging member, and an insulating member formed among the plurality of protrusions of the discharging member, so that discharge is made between the discharging member and the auxiliary member upon application of a voltage between the discharging member and the auxiliary member. Where an interval among distal ends of the plurality of protrusions of the discharging member is denoted as P and an interval between the discharging member and the auxiliary member is denoted as D, P is at least equal to or greater than D.

38 Claims, 12 Drawing Sheets

I-V alteration depending difference of distance from a needle point to a insulating material

CHARGING APPARATUS WITH AUXILIARY MEMBER AND IMAGE FORMING APPARATUS HAVING THE CHARGING APPARATUS

BACKGROUND OF THE INVENTION

1. Field of the Invention

This invention relates to an image forming apparatus such as a photocopier and a printer and, more particularly, to a charging apparatus for removing charges on recording media upon application of charges to the recording media to which toner is transferred.

2. Description of Related Art

Image forming apparatuses such as printers used for output apparatuses for computers, facsimile machines, and photocopiers for forming images with image data read from image scanners are generally, widely used recently.

With respect to image forming men, for example, various kinds such as thermal melting type, thermal sublimation type, thermal transfer type, inkjet type, and electrophotographic type also have been developed in accordance with respective applications as shown in FIG. 8, a full color electrophotography type image forming apparatus using four colors, cyan, yellow, magenta, black in which four process stations 1*a*, 1*b*, 1*c*, 1*d* serving as image forming portions for different colors are arranged, inter alia, has been proposed as a high speed color image forming system (namely; an in-line system).

FIG. 8 is a background art of the invention. In FIG. 8, process stations 1*a* and 1*d* include photosensitive drums 2*a* to 2*d* as image carriers, and latent images are formed on the surface of the photosensitive drums 2*a* to 2*d* upon reception of exposure based on image information by means of exposing apparatus 4*a* to 4*d* such as, e.g., LED (light emitting device) or laser diode, after the surface is charged evenly with primary charging apparatuses 3*a* to 3*d*. The latent images are developed as toner images upon attachment of toners in respective colors by developing apparatuses 5*a* to 5*d*.

The process stations 1*a* to 1*d* are detachably attached to the image forming apparatus, body as process cartridges. The respective process cartridges have a structure in which the photosensitive drums 2*a* to 2*d*, the primary charging apparatuses 3*a* to 3*d*, the developing apparatuses 5*a* to 5*d*, and cleaning means 6*a* to 6*d* are formed in a united body, respectively.

A transfer material S as a recording material contained in a feeding cassette 15 is fed out to the interior of the image forming apparatus body by a feeding roller 16, is conveyed with a register roller pair 17, and then, is conveyed as carried as attracted electrostatically with a transfer conveyance belt 7 serving as a transfer material carrier and with an attracting roller 12 to which an attracting bias voltage of positive polarity is given by means of an attracting bias power supply 13.

The transfer conveyance belt 7 is tensioned with four rollers, a drive roller 8, an attracting facing roller 9, and a pair of tension rollers 10, 11. The respective color process stations 1*a*, 1*b*, 1*c*, 1*d* for cyan, yellow, magenta, and black are disposed substantially vertically with respect to the surface of the transfer conveyance belt 7 in order from the upstream side along the moving direction (arrow a direction in FIG. 8) of the transfer conveyance belt 7.

The transfer material S attracted from the transfer conveyance belt 7 passes sequentially through the respective color process stations 1*a* to 1*d*, thereby electrostatically transferring sequentially the toner images carried on the photosensitive drum is 2*a* to 2*d*. Those toner images are then subject to heat and pressure at a fixing apparatus 18 to be settled on the transfer material S as to form permanent images.

With the apparatus thus described above, however, the transfer material S made of paper or synthetic resin as dielectric is built with charges in a large point because gazing through the transfer process four times when passing through the four process stations 1*a* to 1*d*.

Therefore, separation discharging phenomena occur at a separation portion formed on the peripheral surface of the drive roller 8 from the transfer conveyance belt 7, so that a phenomenon that the toner images transferred onto the transfer material S are disordered according to discharging patterns may occur.

Particularly, such phenomena occur outstandingly where the transfer material S has a high resistance and where the image is formed at an environment of lower temperature and low humidity that easily subjects to static building, or where, in a double side image formation, an image on a second side is formed on a transfer material S in a dried state after the material passes through the fixing process at the first side image formation.

It is therefore general to take resorts to remove charges on the transfer material S by a wire type corona charger 51 when the transfer material S separates from the transfer conveyance belt 7, where the corona charger 51 as shown in FIG. 9 is disposed between the transfer conveyance belt 7 and the fixing apparatus 18 as shown in FIG. 8, thereby canceling image defects upon prevention of discharges at separations.

The corona discharge methods are various, and in general, the corona charger 51 as shown in FIG. 9 is used for obtaining stable discharges. The corona charger 51 shown in FIG. 9 has a tungsten wire 52 having an outer diameter of 60 micron meters shielded with a shield panel 53 having a shape of a rectangular letter U cross section, and a direct current high voltage power supply 54 is connected between the shield plate 53 and the tungsten wire 52.

Such a wire type corona charger 51 can discharge stably and have a feature that good charge removal effects can be obtained easily, but the tungsten wire 52 tends to be readily cut during cleaning when the tungsten wire becomes dirty or during jamming recovery of the transfer material S, so that there is hardship in duration and safety aspect.

On the other hand, a charger having a needle shaped electrode, although not having rifle of wire cutting likewise in the corona charger 51, hardly render stable the charge removal effects because discharges are unstable due to abrupt rising of the current around the discharging threshold, and there are problems requiring some complicated structure to make stable the corona discharge current such that a grid is used at the opening of the charger or that independent resistors are provided where plural needle shaped electrodes are separated electrically from each other.

SUMMARY OF THE INVENTION

It is an object of the invention to provide a charging apparatus having stable discharging property and an image forming apparatus having the charging apparatus.

It is another object of the invention to provide a highly safe charging apparatus and an image forming apparatus having the charging apparatus.

It is yet another object of the invention to provide a charging apparatus including: a discharging member having a plurality of protrusions; and an auxiliary member for assisting discharges by the discharging member, wherein discharge is made between the discharging member and the auxiliary member upon application of a voltage between the discharging member and the auxiliary member, and wherein P is equal to or greater than D where an interval among the distal ends of the plural protrusions of the discharging member and the auxiliary member is denoted as D, and to provide an image forming apparatus having the charging apparatus.

It is still another object of the invention to provide a charging apparatus including: a discharging member having a plurality of protrusions; and an insulating member formed among the plurality of protrusions of the discharging member, wherein the distal ends of the plurality of protrusions of the discharging member stand back from an end of the insulating member, and to provide an image forming apparatus having the charging apparatus.

Further objects of the invention will be apparent from the following description.

DETAILED DESCRIPTION OF THE PREFERRED EMBODIMENTS

Figure 1:
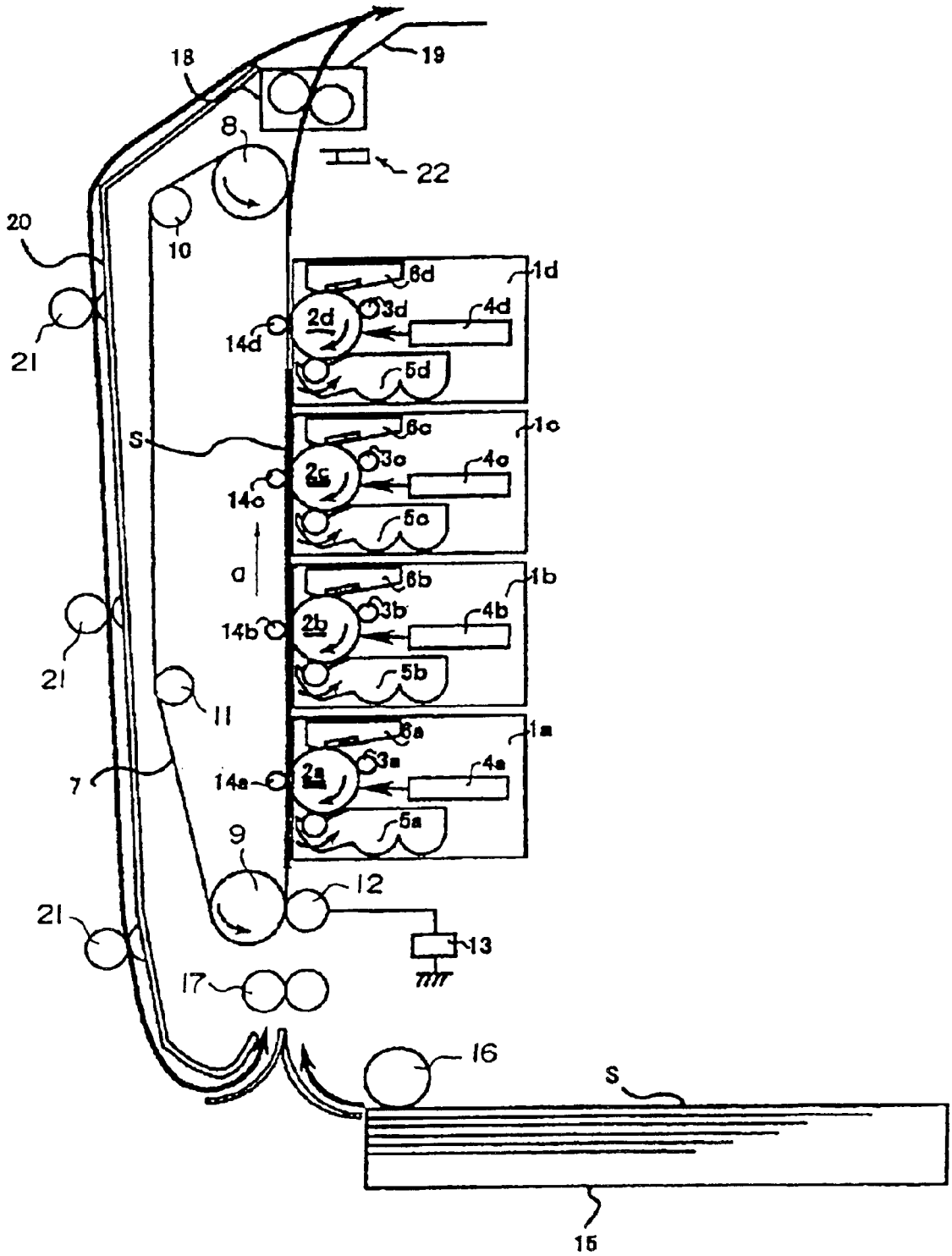
FIG. 1 is a schematic structural view showing an image forming apparatus as an embodiment of the invention.

Referring to the drawings, an embodiment of a charging apparatus according to the invention and an images forming apparatus using a full color electrophotographic method as an example of an image forming apparatus having this charging apparatus, is described in detail.

Figure 2:
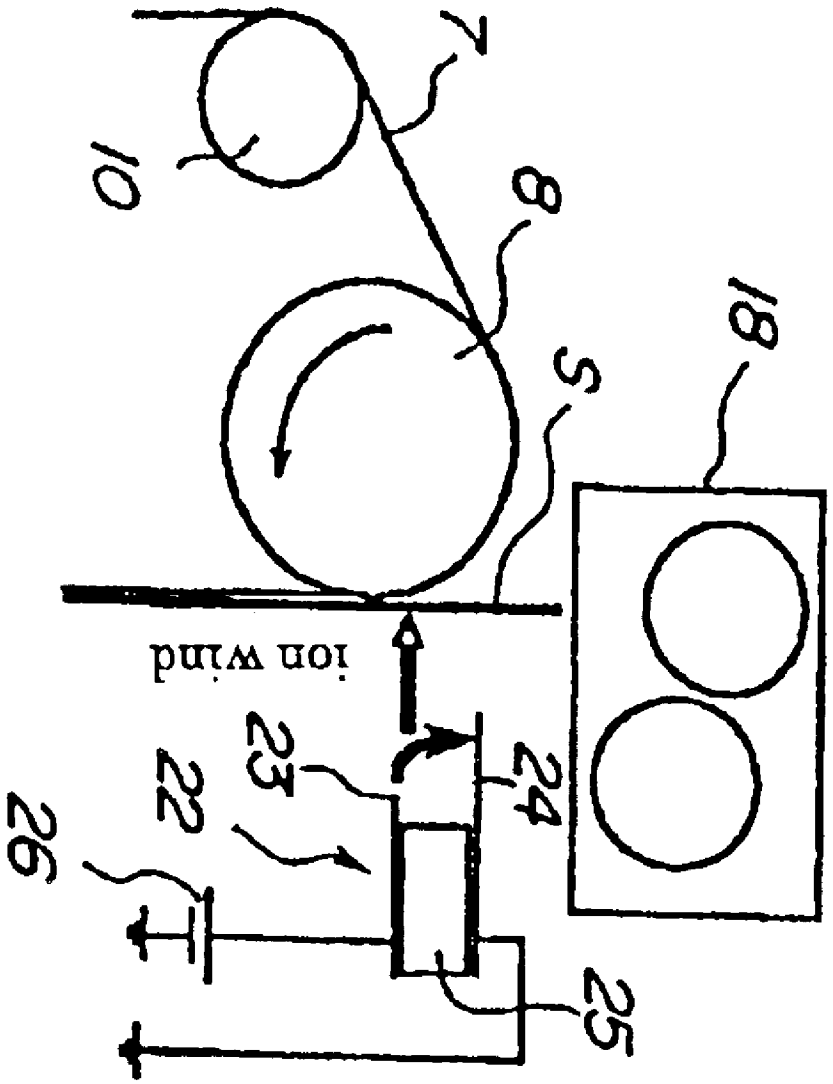
FIG. 2 is an enlarged view around a charging apparatus in FIG. 1.
Figure 3:
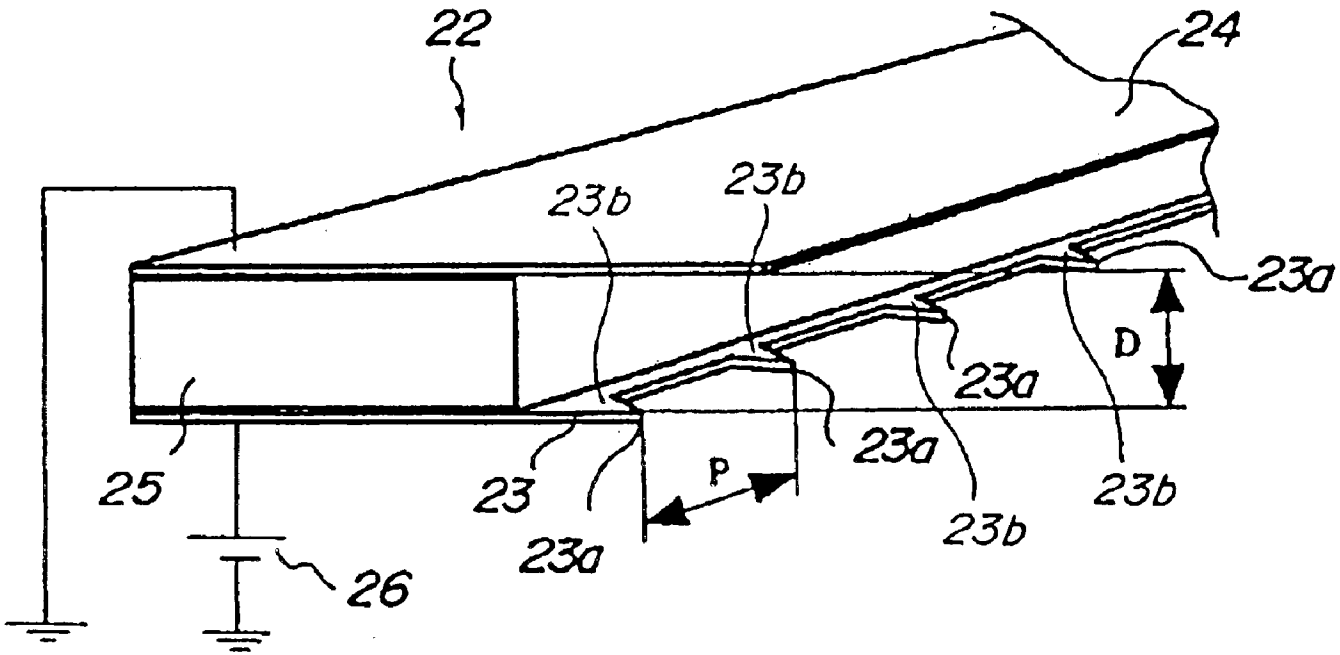
FIG. 3 is a perspective view showing the charging apparatus.

FIG. 1 is a cross section showing schematic structure of an image forming apparatus according to the invention; FIG. 2 is a partly enlarged view showing a layout structure of the charging apparatus according to the invention; FIG. 3 is a perspective view showing the charging apparatus.

First, referring to FIG. 1, a structure of an image forming apparatus having a charging apparatus as an embodiment of the invention is described. The image forming apparatus shown in FIG. 1 is structured as a full color electrophotography type image forming apparatus in which four process stations 1*a*, 1*b*, 1*c*, 1*d* serving as image forming means for four different colors, cyan, yellow, magenta, and black are arranged.

The process stations 1*a* to 1*d* include photosensitive drums 2*a*, 2*b*, 2*c*, 2*d* as image carriers, and latent images are formed on the surface of the photosensitive drums 2*a* to 2*d* upon reception of exposure based on image information by means of exposing apparatus 4*a*, 4*b*, 4*c*, 4*d* such as, e.g., LED (light emitting device) or laser diode, after the surface is charged evenly with primary charging apparatuses 3*a*, 3*b*, 3*c*, 3*d*. The latent images are developed as toner images upon attachment of toners in respective colors by developing apparatuses 5*a*, 5*b*, 5*c*, 5*d*. It is to be noted that numerals 6*a*, 6*b*, 6*c*, 6*d* are cleaning means for cleaning the photosensitive drums 2*a* to 2*d*.

The process stations 1*a* to 1*d* are detachably attached to the image forming apparatus body as process cartridges. The respective process cartridges have a structure in which the photosensitive drums 2*a* to 2*d*, the primary charging apparatus 3*a* to 3*d*, the developing apparatuses 5*a* to 5*d*, and cleaning means 6*a* to 6*d* are formed in a united body, respectively.

A transfer material S as a recording material contained in a feeding cassette 15 is fed out to the interior of the image forming apparatus body by a feeding roller 16, is conveyed with a register roller pair 17, and then, is conveyed as carried is attracted electrostatically with a transfer conveyance belt 7 serving as a transfer material carrier and with an attracting roller 12 to which an attracting bias voltage of positive polarity is given by means of an attracting bias power supply 13.

The transfer conveyance belt 7 is tensioned with four rollers, a drive roller 8, an attracting facing roller 9, and a pair of tension rollers 10, 11 The respective color process stations 1*a*, 1*b*, 1*c*, 1*d* for cyan, yellow, magenta, and black are disposed substantially vertically with respect to the surface of the transfer conveyance belt 7 in the order from the upstream side along the moving direction (arrow a direction in FIG. 1) of the transfer conveyance belt 7. It is to be noted that the transfer conveyance bolt 7 conveys the transfer material from a lower portion to a upper portion in substantially the vertical direction, and the four process stations 1*a*, 1*b*, 1*c*, 1*d* are also arranged in substantially a vertical direction along the transfer conveyance belt 7.

Transfer rollers 14*a*, 14*b*, 14*c*, 14*d* serving as transferring mean are disposed inside the transfer conveyance belt 7 in facing to the respective photosensitive drums 2*a* to 2*d*. When the transfer material S attracted by the transfer conveyance belt 7 passes through the process stations 1*a* to 1*d* of the respective colors, the toner images in respective colors carried on the respective photosensitive drums 2*a* to 2*d* are transferred sequentially electrostatically to a surface of the transfer material S.

A fixing apparatus 18 as a fixing means is disposed on a downstream side in the conveyance direction of the recording material S with respect to the transfer roller 14*d* located on the most downstream side, and a charging apparatus 22 for charging the transfer material S (and removal of charges in a case where the transfer material S is already charged and therefore charges having the opposite polarity to the charged polarity are applied) is arranged between the transfer roller

14*d* located on the most downstream side on the recording material conveyance route and the fixing apparatus 18.

The transfer material S to which the toner images are transferred from the photosensitive drums 2*a* to 2*d* with the transfer rollers 14*a* to 14*d* is separated from the peripheral surface of the drive roller 8 and is conveyed to the fixing apparatus 18 upon removal of the charges by the charging apparatus 22. After the toner images are fixed to the transfer material S by application of heat and pressure at the fixing apparatus 18 to form a permanent image, the transfer material S is delivered onto a delivery tray 19 arranged at the exterior of the apparatus.

The remaining toners remaining on the respective photosensitive drums 2*a* to 2*d* are collected by the cleaning means 6*a* to 6*d*, thereby clearing the surface of the photosensitive drums 2*a* to 2*d*.

In a case that images are formed on both sides of the transfer material S, the transfer material S delivered on the delivery tray 19 is re-fed and reversed by a re-feeding guide 20 and re-feeding rollers 21, conveyed as carried upon attracted by the transfer conveyance belt 7 is substantially the same was as described above, and subject to removal of charges by the charging apparatus 22 as well as separated from the peripheral surface of the drive roller 8 after the toner images are formed on the second (back) side of the transfer material S by operation of the process stations 1*a* to 1*d* and the transfer rollers 14*a* to 14*d*, and then the toner image is fixed onto the transfer material S at the fixing apparatus and the transfer material S is delivered to the delivery tray 19 located at the exterior of the apparatus.

Next, the charging apparatus 22, in FIGS. 2 and 3, as an embodiment of the invention is described. With the charging apparatus 22, a needle shape electrode 23 as a discharging member in which needle distal ends 23*a* of needles 23*b* as plural protrusions are arranged linearly with prescribed intervals, and a discharge auxiliary metal plate 24 serving as a discharging auxiliary member (discharging auxiliary electrode) disposed near the needle distal ends 23*a* of needles 23*b* are formed in an electrically insulated manner via an insulating spacer 25 as an insulating member, and the discharge auxiliary metal plate 24 is grounded whereas the positive side of a high voltage direct current power source 26 as a voltage application means is electrically coupled to the needle shape electrode 23. It is to be noted that the needle shape electrode 23 and the discharge auxiliary metal plate 24 are in a plate shape, and are provided in parallel as facing to each other.

The transfer material S can be subject to removal of charges by application of charges to the transfer material S structured of such as paper or synthetic resin as a body to be charged which is located near the needle shape electrode 23 by discharge between the needle shape electrode 23 and the discharge auxiliary metal plate 24 upon application of the direct current voltage between the needle shape electrode 23 and the discharge auxiliary metal plate 24 by means of the high voltage direct current power source 26.

A numeric value of a mutual isolated distance (hereinafter referred to as "pitch") among the plural needle distal ends 23*a* of the needle shape electrode 23 when the unit thereof is expressed with "mm" is denoted as P; a numerical value of an isolated distance between the needle distal end 23*a* of the needle shape electrode 23 and the disc auxiliary metal plate 24 when the unit thereof is expressed with "mm" is denoted as D; a numerical value of the voltage applied between the needle shape electrode 23 and the discharge auxiliary metal plate 24 when the unit thereof is expressed with "kV" is denoted as V; and the embodiments are described as follows.

Figure 4:
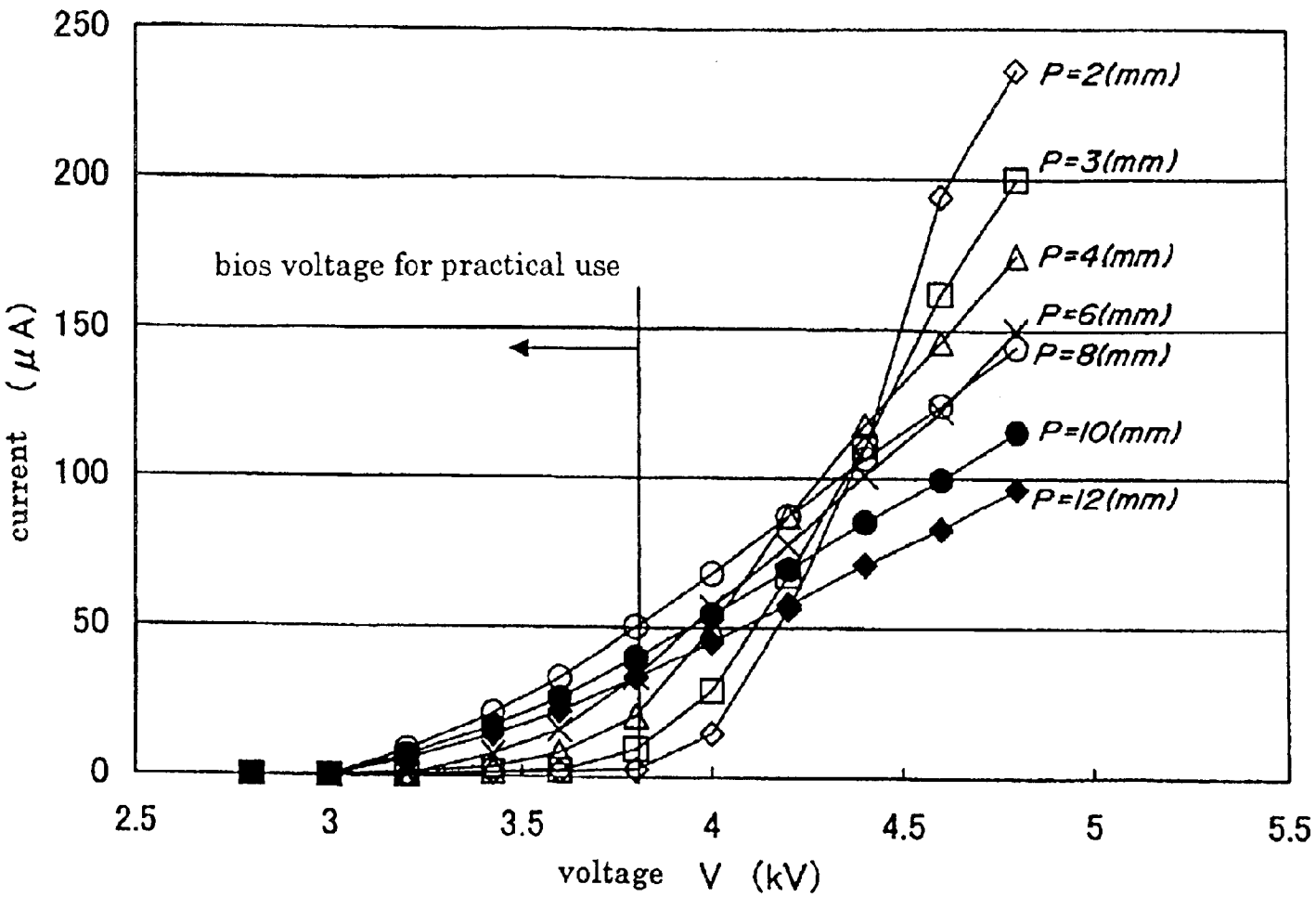
FIG. 4 is a diagram showing a relation between applied voltage and discharge current at an isolation distance among plural needle distal ends.

FIG. 4 is a digram showing a relation between applied voltage and discharge current at each pitch P, and shows a relation between respective applied voltages and discharge current where the numerical value P (mm) of the mutual isolated distance (pitch) among the plural needle distal ends 28*a* is set to 2 (mm), 3 (mm), 4 (mm), 6 (mm), 8 (mm), 10 (mm), 12 (mm) when the unit thereof is expressed with "mm " where the numerical value D of the isolated distance between the needle distal end 23*a* of the needle shape electrode 23 and the discharge auxiliary metal plate 24 when the unit thereof is expressed with "mm" is equal to 4 (mm).

According to this diagram, it is turned out that, where the pitch P (mm) is equal to 2 (mm), the discharge start voltage is high, and a stable discharge phenomenon is hardly obtained due to abrupt changes of the discharging current according to increase of the voltage V.

Therefore, as shown in FIG. 4, as the pitch P (mm) is widened, the discharge start voltage is lowered, and therefore, the discharge phenomenon becomes stable where the relation between the applied voltage and the discharge current is changed nearly linearly.

This is because potential interference of the needle distal ends 23*a* adjacent to each other of the needle shape electrode 23 is avoided by widening the pitch P (mm), thereby concentrating the electric field with good efficiency for each needle 23*b* of the needle shape electrode 23.

According to FIG. 4, where P is equal to 4 (mm) or more, the relation between applied voltage and discharge current at a voltage equal to or under the using voltage, changes closely linearly, and under a condition that discharge becomes stable, P is equal to or greater than D because D=4 (mm) in FIG. 4. It is usable as a practical matter in a region of $P \geqq D$, and furthermore, it is more desirable to use the region satisfying $P \geqq D$. If the pitch P (mm) is excessively widened, charging unevenness may occur to the transfer material S serving as a material to be charged, and to prevent this from occurring, it is preferable to set $5D \geqq P$.

In this embodiment, thus, where $P \geqq D$ is satisfied, the discharging property of the charging apparatus can be made stable, and therefore, the charges of the transfer material can be removed well.

That is, this embodiment can avoid occurrence of discharge phenomenon when the transfer materials built with charges in a large amount through the transfer process is subject to removal of charges and separated from the transfer conveyance belt 7, and can prevent image defects from occurring upon prevention of occurrence of phenomenon that the toner images transferred onto the transfer material S are disturbed along discharge patterns.

Figure 5:
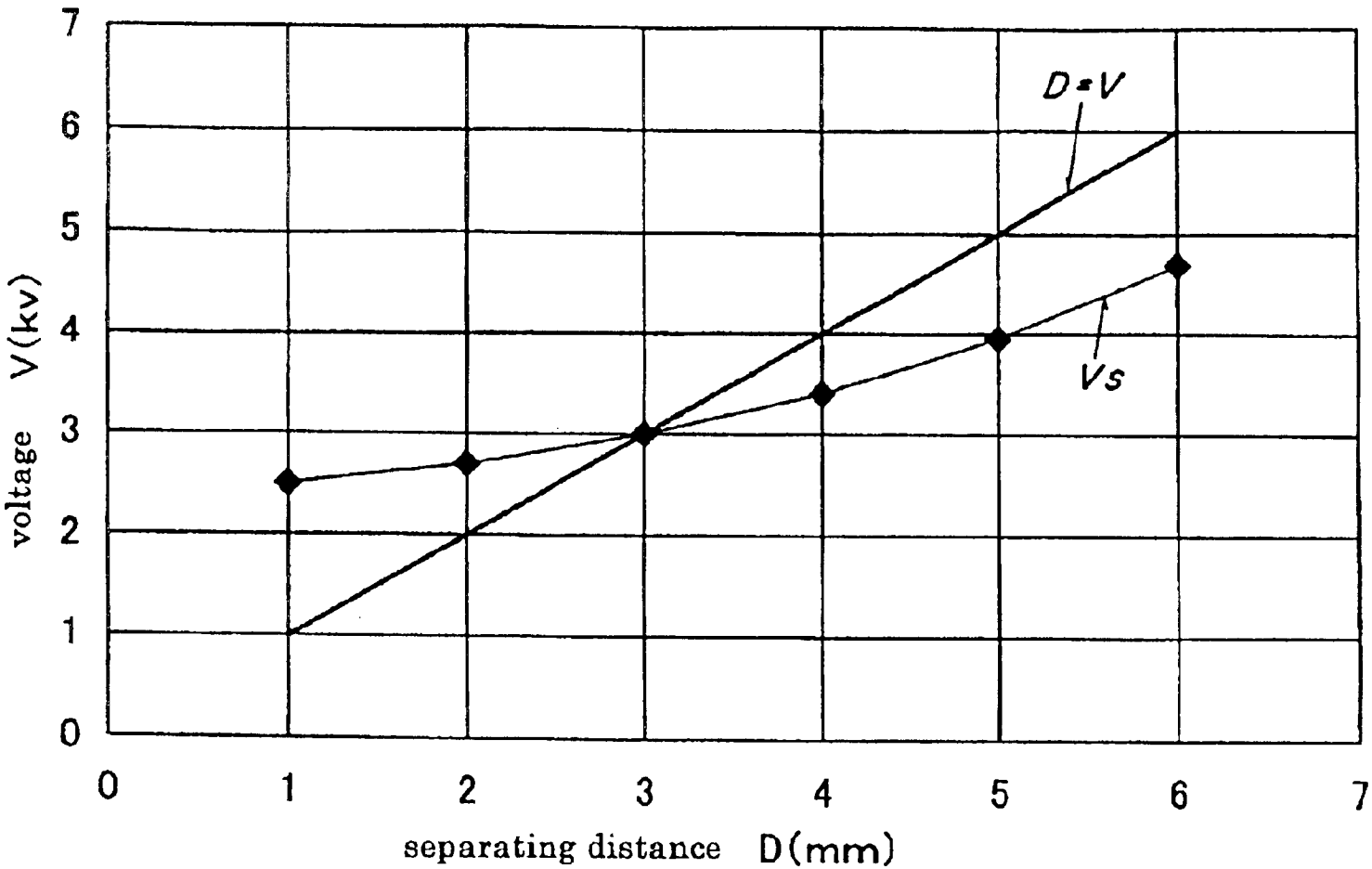
FIG. 5 is a diagram showing a discharge start voltage.

FIG. 5 is a diagram showing a relation between isolated distance D and discharge start voltage Vs. In general, where a high voltage is applied to a conductive member, it is preferable to set $D1 \geqq V1$, where the numerical value of the isolated distance between both conductive members when the unit thereof is expressed with "mm" is denoted as D1, and where the numerical value of the potential difference when the unit thereof is expressed with "kV" is denoted as D1 is denoted as V1, from a viewpoint to surely prevent leakage to other conductive members from occurring.

In a case of the charging apparatus 22 structured as shown in FIG. 3, the isolated distance D (mm) satisfying the condition of $D \geqq Vs$ is $D \geqq 3$ on the basis of FIG. 5 where a numerical value of an isolated distance between the needle distal end 23*a* of the needle shape electrode 23 and the discharge auxiliary metal plate 24 when the unit thereof is expressed with "mm" is denoted as D, and where a voltage starting discharge with respect to respective isolated distances D (mm) when the unit thereof is expressed with "kV" is denoted as Vs.

That is, to prevent charge leakage from occurring surely between the needle shape electrode 23 and discharge auxiliary metal plate 24, it is preferable to set D≧V, and more preferably, it is D≧3 as a practical matter.

Accordingly to render the discharge characteristics stable and to prevent the charge leakage from occurring, it is preferable to set P≧D≧V, and it is more preferable to set D≧3.

Figure 6:
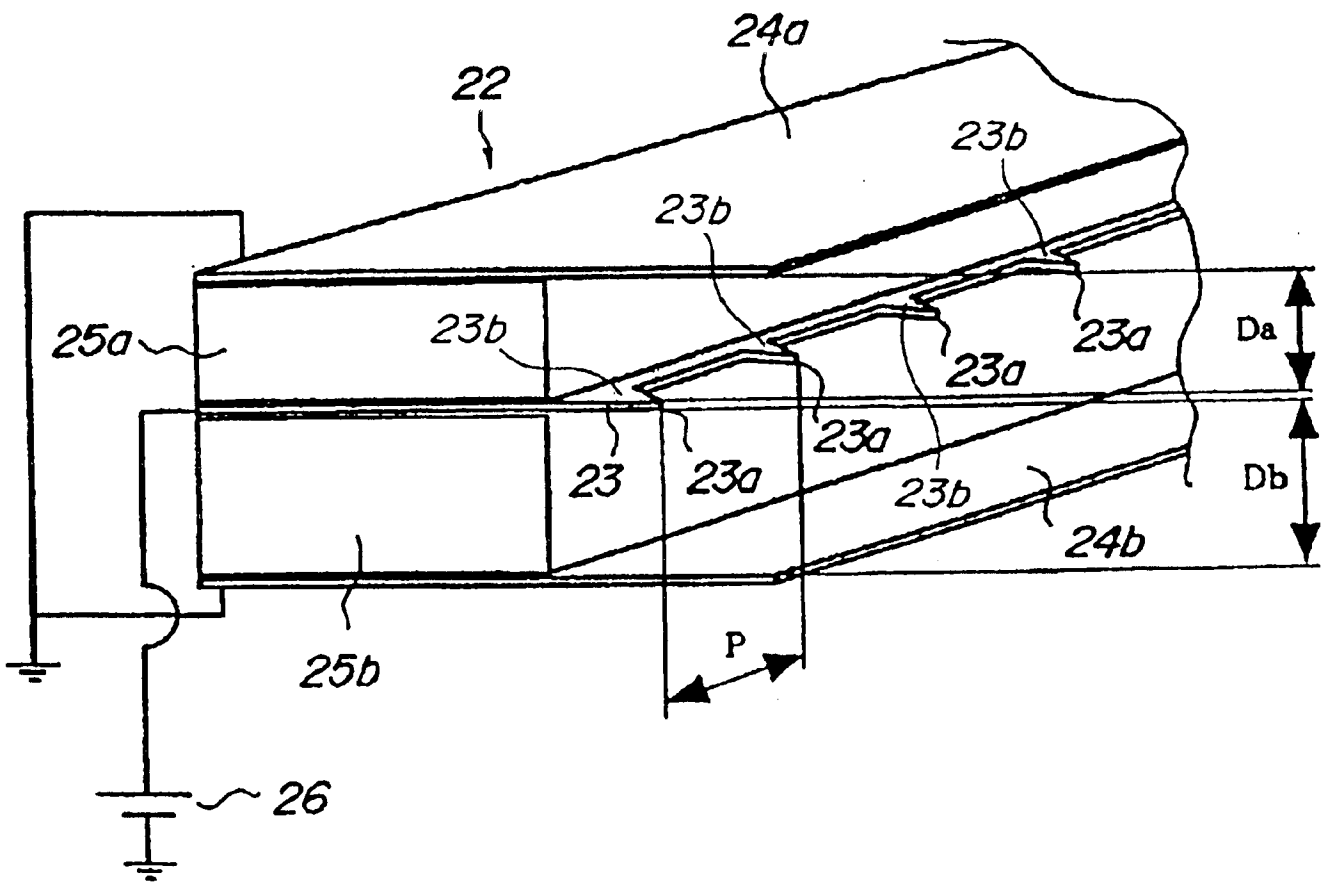
FIG. 6 is a perspective view showing a charging apparatus as another embodiment of the invention.

Next, another embodiment of the invention is described. FIG. 6 is a perspective view showing a charging apparatus 22 as another embodiment of the invention. This charging apparatus 22 is applicable to an image forming apparatus shown in FIG. 1. As shown in FIG. 6, discharge auxiliary metal plates 24*a*, 24*b* as discharging auxiliary members are provided on each side of a needle shape electrode 23 serving as a discharging member as a center via insulation spacers 25*a*, 25*b* as an insulation member in an electrically isolated manner, and the discharge auxiliary metal plates 24*a*, 24*b* are grounded, and the positive polarity side of a high voltage direct current power supply 26 is electrically coupled to the needle shape electrode 23 insulation spacers 25*a*, 25*b* sandwiched between the needle shape electrode 23.

With the charging apparatus 22 structured as shown in FIG. 6, further stable discharge characteristics can be obtained upon the increased discharge current amount per one needle 23*b* of the needle shape electrode 23, so that the removal of the charge on the transfer material S can be done stably.

In this situation, where numerical values of respective isolated distances between needle distal end 23*a* of the needle shape electrode 23 and the respective discharge auxiliary metal plates 24*a*, 24*b* when the unit thereof is expressed with "mm" are denoted as Da, Db, and where there is a relation of Da≦Db, the isolated distance Da between the needle distal end 23*a* of the needle shape electrode 23 and the discharge auxiliary metal plate 24*a* nearer with respect to the isolated distance is set as satisfying P≧Da. It is to be noted that P denotes the interval among the needle distal ends 23*a* of the plural needles 23*b* as described above.

As described above, by setting the isolated distances D (Da, Db) (mm) between the needle distal end 23*a* of the needle shape electrode 23 and the respective discharge auxiliary metal plates 24 (24*a*, 24*b*) of the charging apparatus 22 to be proper distance as to satisfy P≧D, and by optimizing the mutual isolated distance (pitch) P (mm) of the needle distal and 23*a* of the needle shape electrode 23, stable charging and discharging characteristic can be obtained with a simple structure where the discharge start voltage Vs is lowered, where the potential interferences among the needle distal ends 23*a* are prevented, and where concentration of the electric field is achieved with good efficiency.

In this embodiment, where the discharge performance is made stable, and where the charge leakage is prevented, it is preferable to set P≧D≧V, and it is more preferable to set D≧3.

Herein, a specific embodiment is described. In the image forming apparatus shown in FIG. 1, the charging apparatus 22 show in FIG. 3, FIG. 6 is disposed on a tide of the toner image of the transfer material S at a transferring portion of the transfer material S from the transfer conveyance belt 7 to the fixing apparatus 18, in lieu of the corona charger 18 of the wire type of the background art shown in FIG. 8, FIG. 9. The isolated distance between the transfer material S constituted of paper or synthetic resin as a material to be changed in this situation and the charging apparatus 22 is set about. e.g. 10 mm 50 mm.

The transfer material S receives charges in a large amount because going through our time transfer processes by means of the respective transfer rollers 14*a* to 14*d* when passing through the four process stations 1*a* to 1*d*, and holds charges upon application of a high voltage about, e.g., −3000 V.

Therefore, if no charging apparatus 22 is provided, discharge phenomenon may occur at a separation portion structured by the peripheral surface of the drive roller 8 on the transfer conveyance belt 7, and a phenomenon that toner images transferred onto the transfer material S are disordered along discharge patterns may occur. Particularly, such phenomena occur outstandingly where the transfer material S has a high resistance and where the image is formed at an environment of low temperature and low humidity that easily subjects to static building, or where, in a double side image formation, an image on a second side is formed on a transfer material S in a dried state after the transfer material S passes through the fixing apparatus 22 at the first side image formation.

To prevent such image disorder caused by discharge phenomenon, the charging apparatus 22 is disposed between the transfer conveyance belt 7 and the fixing apparatus 18 on the conveyance route for the recording media, and a corona discharge is generated by the charging apparatus 22, on a peripheral surface of the drive roller 8 for separating the transfer material S from the transfer conveyance belt 7, under conditions setting that the mutual isolated distance P among the needle distal end 23*a* of the needle shape electrode 23 of the charging apparatus 22 is equal to 8 (mm), that the isolated distance D (or Da, Db) between the needle distal end 23*a* of the needle shape electrode 23 and the respective discharge auxiliary metal plates 24 (24*a*, 24*b*) of the charging apparatus 22 is equal to 4 (mm), and that the voltage V (kV) applied between the needle shape electrode 23 and the discharge auxiliary metal plate 24 (or 24*a*, 24*b*) is equal to 3.8 (kV).

In a case that no transfer material S exists, for instance, substantially all of discharge currents of 60 μA may flow in the discharge auxiliary metal plate 24 (or 24*a*, 24*b*) by the corona discharge of the charging apparatus 22, and if the transfer material S applied with a high voltage (for example, −8000V as described above) passes Corn this state as a material to be charged facing to the charging apparatus 22 at a rate of e.g., 100 mm/sec, the corona discharge current is increased from 60 μg to e.g., 70 μA due to changes in the electric field around the needle shape electrode 23, so that a part of the current flows, as shown in FIG. 2, as an ion blow to the transfer material S, thereby removing charges on the transfer material S and preventing the image defects from occurring due to discharges at separation.

Figure 7:
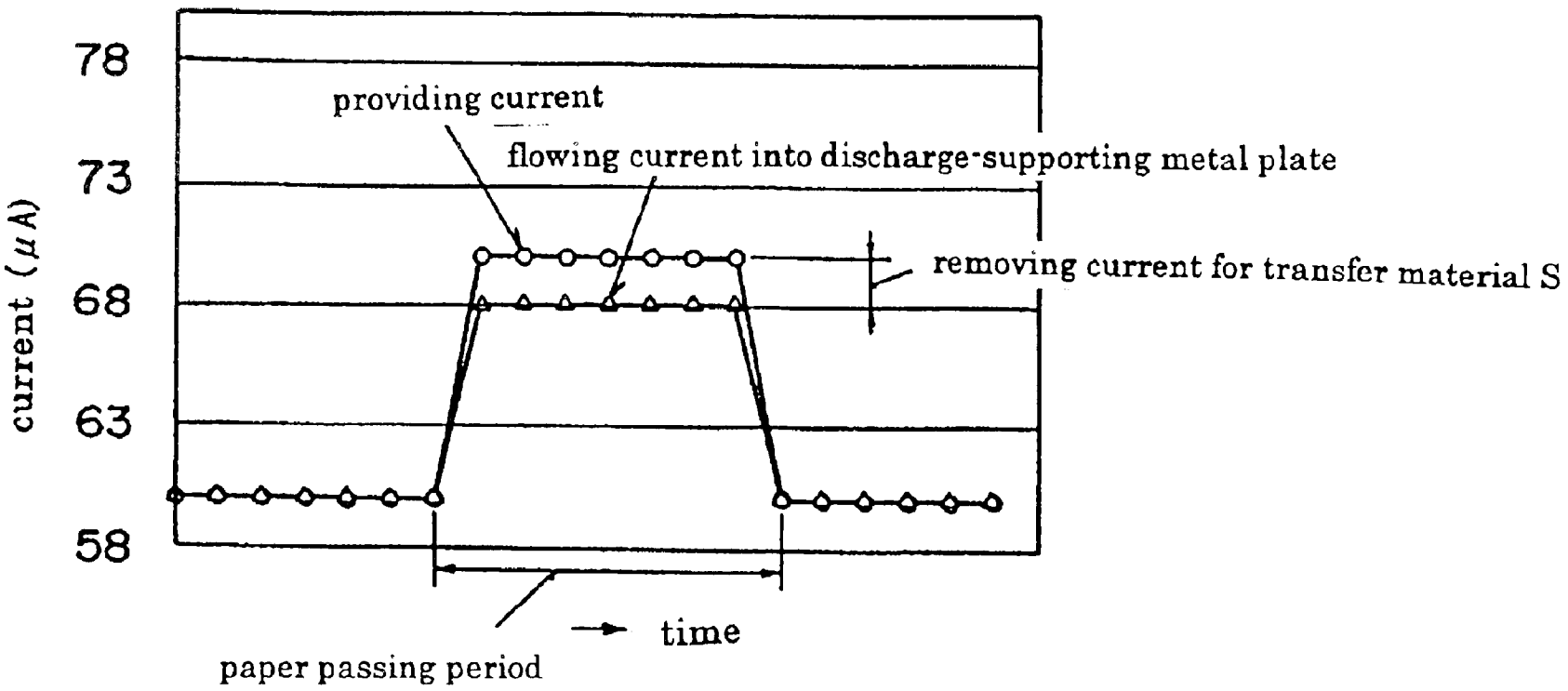
FIG. 7 is a diagram showing changes in current amount on a time basis.

The current amount flowing in as the ion blow to the transfer material S is, at this situation, 3 μA or less at most. FIG. 7 is diagram showing an example of a relation between input current to the needle shape electrode 23 and current flowing in the discharge auxiliary metal plate 24 (24*a*, 24*b*).

According to the above structure, the transfer material S is subject to removal of charges by the corona discharge of the charging apparatus 22 when the transfer material S is separated from the transfer conveyance belt 7, thereby preventing discharge at separation from occurring.

Figure 8:
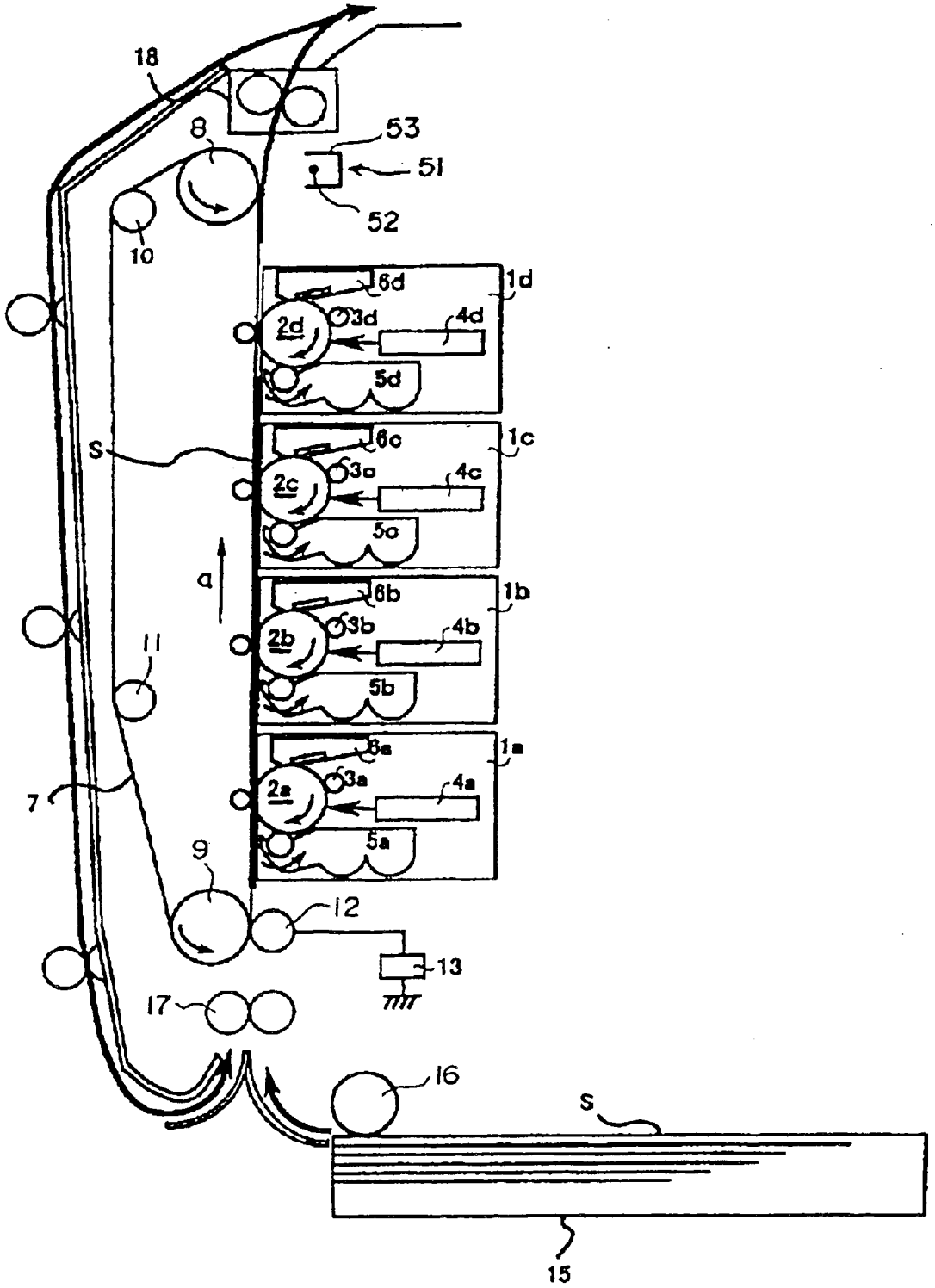
FIG.8 BACKGROUND ART
FIG. 8 is a schematic structural diagram showing an image forming apparatus as a background art of the invention.
Figure 9:
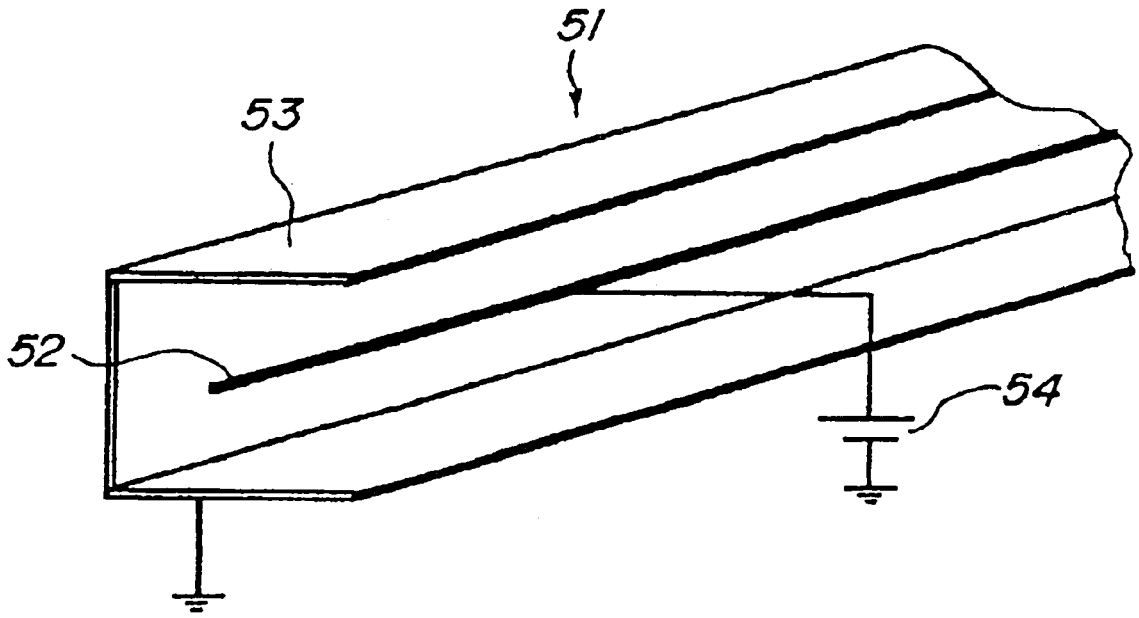
FIG.9 BACKGROUND ART
FIG. 9 is a diagram showing a charging apparatus in FIG. 8.

Accordingly, the charging apparatus 22 capable of performing durable and stable discharge operation can be provided without any problem such as cut of tungsten wire 52 likewise in the corona charger 51 using the tungsten wire 52 as shown in FIG. 8, FIG. 9 and without Any necessity to make a plan for safety against leakage or the like done by other resorts.

Thus, this invention owns the above described structured and effects, and therefore, a safe charging apparatus with stable discharge performance can be provided by setting properly the mutual isolated distance (pitch) among the needle distal ends 23*a* of the needle shape electrode 23 of the charging apparatus 22 and the isolated distance between the needle distal end 23*a* of the needle shape electrode 23 and the discharge auxiliary member 24.

Application of this charging apparatus 22 particularly to the electrophotography type image forming apparatus prevents image defects from occurring due to discharge phenomenon, thereby performing charging and discharging of the prescribed members.

Next, another embodiment is described in consideration of a safety aspect such that, for example, fingers of the user may not touch directly the needle shape electrode 23 during jamming recovery or the like, or that the transfer material S does not contact the needle shape electrode 23 in case where the transfer material S enters to the charging apparatus 22 without being properly separated.

Figure 10:
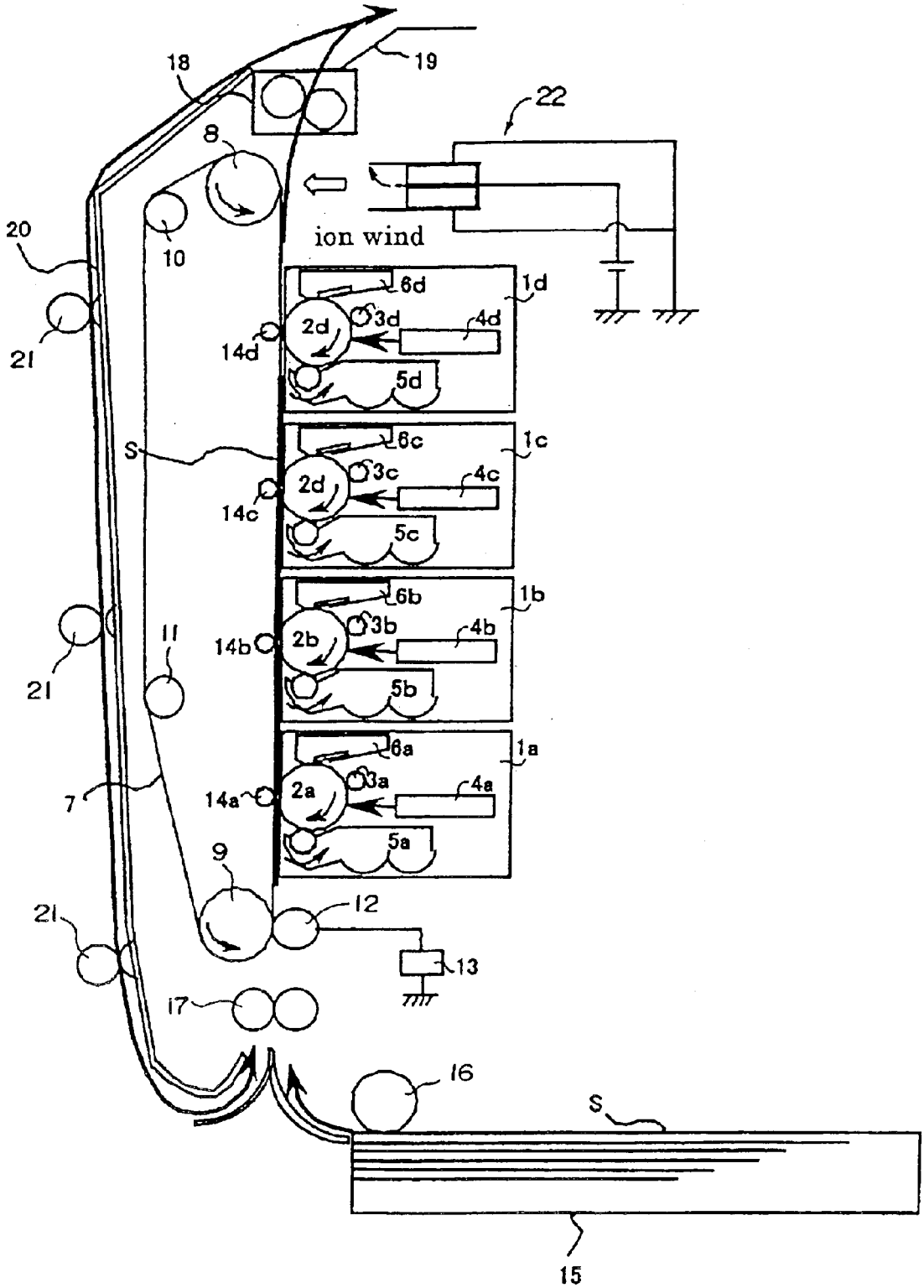
FIG. 10 is a schematic structural diagram showing an image forming apparatus as another embodiment of the invention.

FIG. 10 is an illustration showing an image forming apparatus as an embodiment of the invention. This is basically the same as the image forming apparatus in FIG. 1, and differences are described below.

Figure 11:
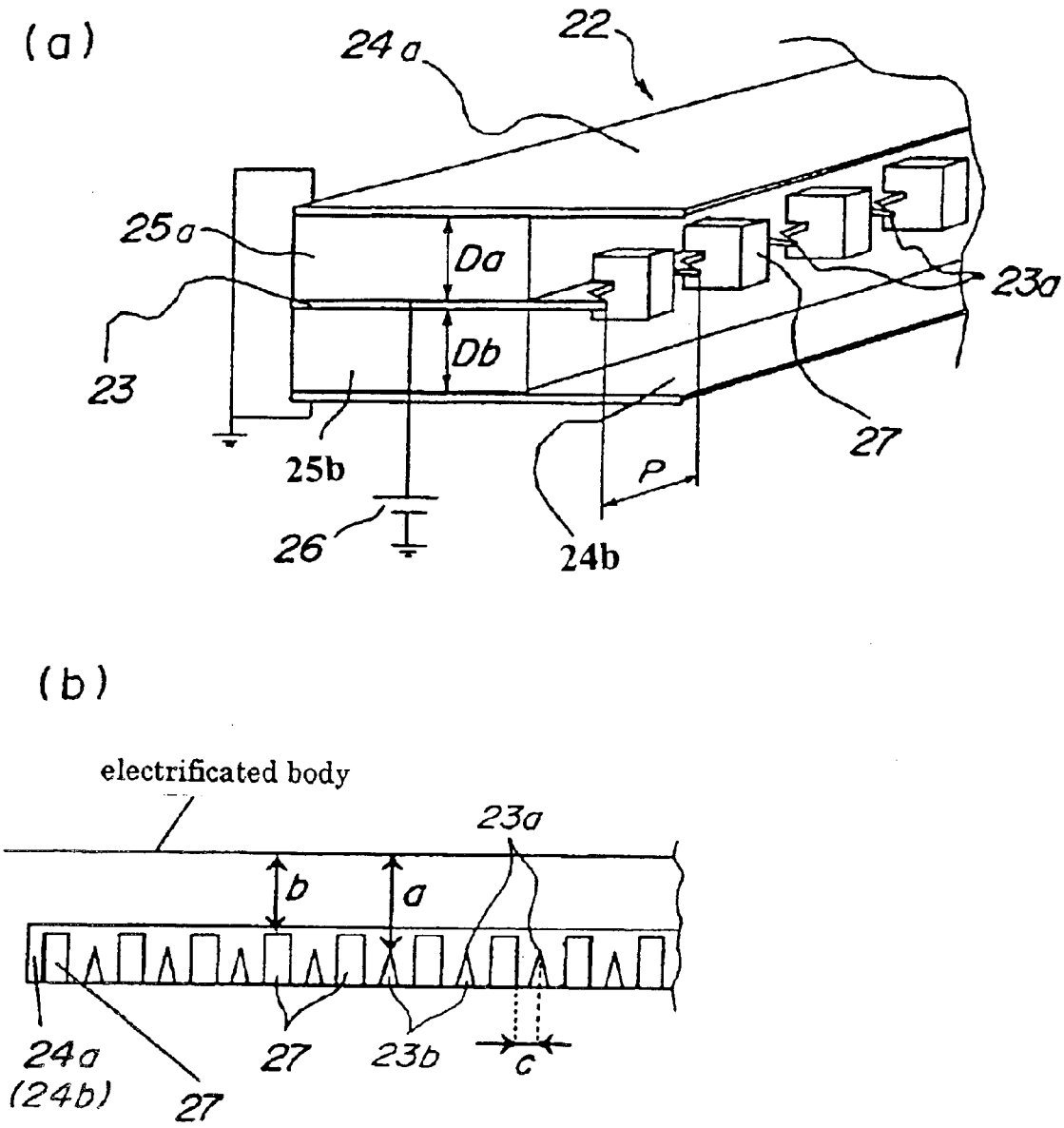
FIGS. 11(*a*) and 11(*b*) are diagrams showing a charging apparatus in FIG. 10.

FIGS. 11(*a*) and 11(*b*) are diagrams showing a charging apparatus 22 of this embodiment. With this charging apparatus 22, because P≧D is set (providing D is the smaller one between Da and Db), stable discharging performance is obtainable. In this embodiment, also, where the discharge performance is made stable, and where the charge leakage is prevented, it is preferable to set P≧D≧V, and it is more preferable to set D≧3.

As a feature of this embodiment, a structure is described in which electrical insulation members 27 in a protrusion shape are arranged among the needles (charge removing needles) 23*b* of the needle shape electrode 23. The charging apparatus 22 as shown in FIG. 11(*a*), includes needle shape electrode 23, facing electrode plates 24*a*, 24*b* as discharging auxiliary members facing astride a prescribed space distance D (Da,Db) to the needle shape electrode 23 insulation spacers 25*a*, 25*b* sandwiched between the needle shape electrode 23 and the facing electrode plates 24*a*, 24*b*, and insulation members 27 in a protrusion shape disposed between the needle shape electrode 23 and the needle 23*b*. The needle shape electrode 23 is coupled to a high voltage power source (high voltage application means) 26, and the facing electrode plates 24*a*, 24*b* are grounded.

FIG. 11(*b*) shows a structure of the needles 23*b* having needle distal ends 23*a*, the facing electrode plates (metal plates) 24*a*, 24*b*, and the insulation members 27, and a positional relation among those and the material to be charged. The respective needles 23*b* are arranged linearly with equal intervals and substantially vertically with respect to the material to be charged, an the insulating members 27 are formed among the needles 23*b*. The two facing electrode plates 24*a*, 24*b* are disposed in parallel to the needle shape electrode 23, and are in a shape sandwiching the needle shape electrode 23.

In this embodiment, the insulation member 27 in the protrusion shape is formed to satisfy the relation a>b, where the distance between the material to be charged such as a transfer material or the like and the needle distal end 23*a* of the needle 23*b* is denoted as a, and where the distance between the material to be charged and the distal end of the insulation member 27 is denoted as b. That is, the needle distal end 23*a* of the needle 23*b* is drawn back from the end of the insulation member 27 toward the opposite side to the transfer material side.

With this structure, in this embodiment, because the needle 23*b* is guarded by the insulation member 27, the fingers of the user may not touch directly the charge removing needle 23*b*, and the transfer material S does not contact the charge removing needle 23*b* in case where the transfer material enters charging apparatus 22 without being properly separated, so that the safety property can be improved.

Figure 12:
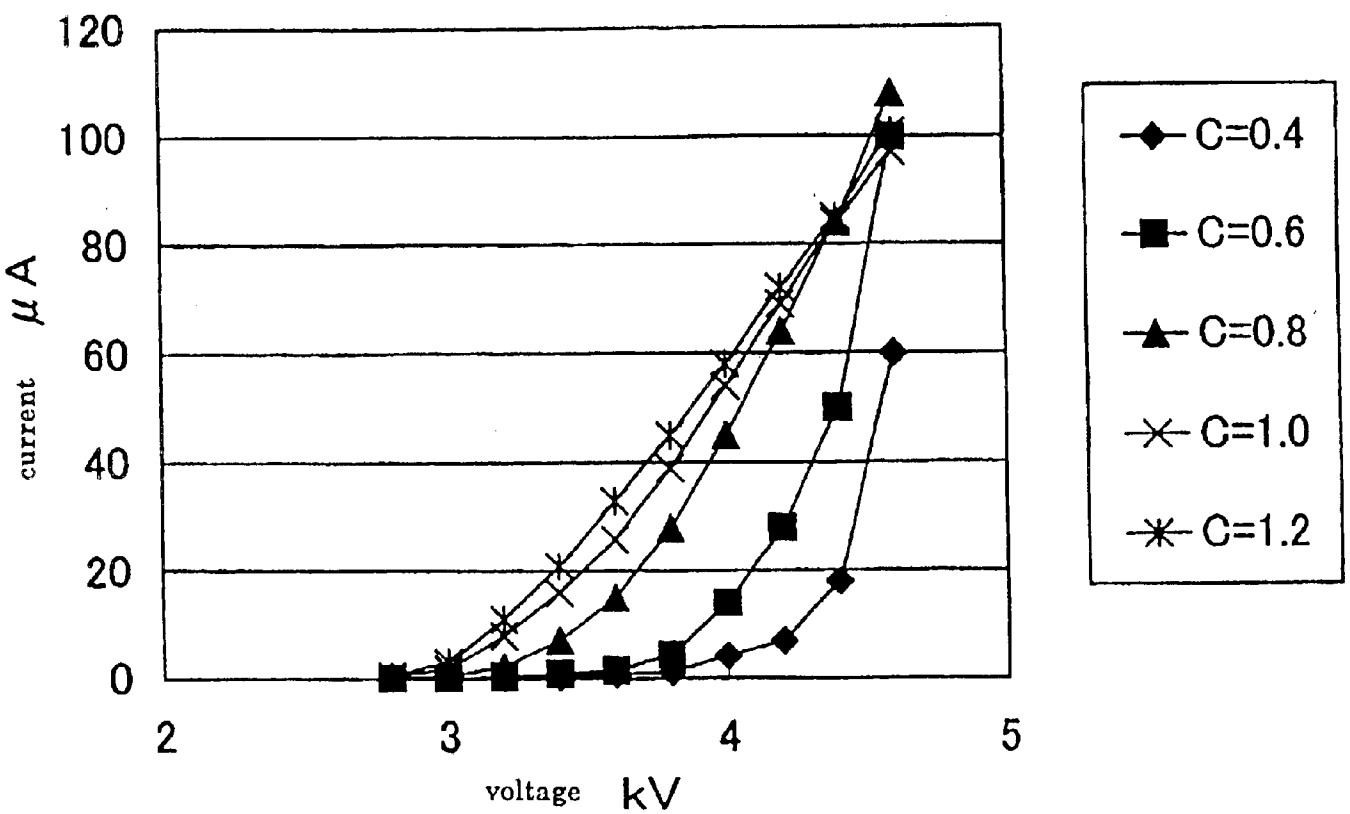
FIG. 12 is a diagram showing discharging characteristics where the distance between the distal end of a charge removal needle and an insulation member is changed.

FIG. 12 shows discharge characteristics where it is set that D(Da, Db)=4 mm, P=8 mm, a–b=1.5 mm, and where the distance c between the needle distal end 23*a* of the needle 23*b* and the nearest insulation member 27 is changed. As apparent from FIG. 12, if the value c becomes 0.6 mm or less, the discharge start voltage becomes higher, and the current changes abruptly as the voltage is increased, so that it is turned out that stable discharge phenomenon is hardly obtainable. This is the result that the discharge is distributed due to building of charge in the insulation members 27. Therefore, practically, it is preferable to set the value c to be 0.8 mm or more at which the discharge becomes stable.

As described above, the charging apparatus 22 can enjoy stable discharge phenomenon in guarding the needles 23*b* where a>b, c≧0.8 are set.

Herein, a specific example of the embodiment is described. In an image forming apparatus shown in FIG. 10, as a preventative example in this embodiment, images are formed with a reverse developing method, in which negative charged toner is used at −700 V at a dark portion potential and at −400 V at a developing potential to perform transfer with a bias of a positive polarity.

The transfer conveyance belt 7 is of resistance amount controlled to be 1E9 Ωcm volume resistance in adding ion conductive agents to a resin made of PVdF, having a thickness of100 μm of a single layer structure. As the volume resistance value, used is a value normalized with a belt thickness from a measured value in application of 100 V at a high resistance meter R8340 made of ADVANTEST Corp. in use of a measuring prove in compliance with JIS-K6911 method.

The attracting roller 12 is molded from a solid rubber on a metal core having a diameter of 6 mm, and has a structure that an attracting bias power source 13 for attraction can be fed to the metal core. The attracting roller 12 is a solid rubber roller having a diameter of 12 mm in which carbon black is dispersed to adjust the resistance in a PDM rubber, and the resistance is adjusted to be 1E5 Ωcm where a metal foil having a width of 1 cm is wound around the outer periphery of the roller and where a voltage of 500 V is applied to the metal core.

The transfer rollers 14*a* to 14*d* are made of a metal core of 6 mm and a single layer roller of an outer diameter of 12 mm. The material of the rollers is mixed of NBR rubber with epichlorohydrin rubber, blended with anti-oxidant such as amine system, phenol system, phosphoreus system, sulfur system, and the like, molded with an extrusion method, and polished. The resistance value is set to be 5E6 Ω where a metal foil having a width of 1 cm is wound around the outer periphery of the roller and where a voltage of 500 V is applied to the metal core.

The charging apparatus 22, in which the insulation members 27 in the protrusion shape are formed among the needle shape electrode 23, is disposed on an image surface side at a transfer portion between the transfer conveyance belt 7 and the fixing apparatus 18. At that time, the transfer material S receives a large amount of charges because going through the four time transfer processes while passing through the four process stations 1*a* to 1*d*, and holds a high potential such as e.g., −3000 V. Therefore, if no charging apparatus 22 is provided, discharge phenomenon at separation may occur at a separation point of the transfer conveyance belt 7, so that a phenomenon that the toner images transferred onto the transfer material S are disordered along discharge patterns may occur. Particularly, such phenomena occur outstandingly where the transfer material S has a high resistance and low humidity that easily subjects to static building, or where, in a double side image formation, an image on a second side is formed on a transfer material S in a dried state after the transfer material S passes through the fixing apparatus 18 at the first side image formation.

To prevent the image disorders due to discharge phenomenon at separation from occurring, the charging apparatus 22 as shown in FIG. 10 is disposed between the transfer conveyance belt 7 as shown in the drawing and the fixing apparatus 18, and corona discharge is generated using the charging apparatus 22 under the conditions of P=8 mm, D=4 mm, V=3.8 kV, a–b 1.5 mm, c=1.0 mm as an example at a point where the transfer material S separates from the transfer conveyance belt 7.

In a case that no transfer material S exists, for instance, substantially all of discharge currents of 60 $\mu$A may flow in the electrode plates 24*a*, 24*b* by the corona discharge of the charging apparatus 22, and if the transfer material S applied with a high voltage (for example, −3000V as described above) passes from this state as a material to be charged at a rate of e.g., 100 mm/sec, the corona discharge current is increased from 60 $\mu$A to e.g., 70 $\mu$A due to changes in the electric field around the needle shape electrode 23, so that a part of the current flows, as shown in FIG. 10, as an ion blow to the transfer material S, thereby removing charges on the transfer material S and preventing the image defects from occurring due to discharges at separation. The current amount flowing in the transfer material S as an ion blow is 3 $\mu$A or less at most. The relation between the input current to he needle shape electrode 23 and the current flowing in the facing electrode plates 24*a*, 24*b* are substantially the same as in FIG. 7.

As described above, in this embodiment, the transfer material S does not contact the needle shape electrode 23 in case where the transfer material S enters to the charging apparatus 22 without being properly separated, and fingers of the user can be prevented from touching directly the distal end 23*a* of the needle shape electrode 23, because the transfer material S is subject to removal of charges by the corona discharge by means of the charging apparatus 22 during separation from the transfer conveyance belt 7 to prevent the discharge at separation from occurring and to render the needle shape electrode 23 guarded with the insulation member 27 in the safety aspect, where the distance between the distal end 23*a* of the charge removing needle 23*b* and the material to be charged is denoted as a, where the distance between the distal end of the insulation member 27 and the material to be charged is denoted as b, where the distance between the distal end 23*a* of the charge removing needle 23*b* and the nearest insulation member 27 is denoted as c, and where it is set as a>b.

In this embodiment, the discharge property can be improved where c≧0.8 mm is set.

It is to be noted that in the embodiments described above, exemplified are examples or charge removal to the transfer material S of an in-line type, but this invention is not limited to this, for example, this invention is applicable to charging and discharging done by image carriers, transfer conveyance belts, fixing apparatuses, and the like, and any combination of those can be used.

In the embodiments described above, the printers are exemplified as an image forming apparatus, but this invention is not limited to this, and for example, facsimile machines, and photocopiers can be used for this invention.

Although the embodiments according to the invention are thus described, the invention is not limited to the above embodiments and can be modified within the technical concept of the invention.

What is claimed is:

1. A charging apparatus comprising:

a discharging member having a plurality of protrusions; and an auxiliary member for assisting discharges by the discharging member;

wherein discharge is made between the discharging member and the auxiliary member upon application of a voltage between the discharging member and the auxiliary member; and wherein, where an interval among distal ends of the plurality of protrusions of the discharging member is denoted as P and an interval between the discharging member and the auxiliary member is denoted as D, P is equal to or greater than D.

2. The charging apparatus according to claim 1, wherein the discharging member is an electrode having plural needle portions, and the auxiliary member is an auxiliary electrode.

3. The charging apparatus according to claim 1, wherein a voltage is fed to an electrode whereas the auxiliary member is grounded.

4. The charging apparatus according to claim 1, wherein the discharging member and the auxiliary member are in a plate shape and are faced to each other as being in parallel.

5. The charging apparatus according to claim 1, wherein D is equal to or greater than V where an interval between the discharging member and the auxiliary member is denoted as D(mm) and a voltage fed between the discharging member and the auxiliary member is denoted as V (kV).

6. The charging apparatus according to claim 1, wherein D is equal to or greater than 3 (mm).

7. The charging apparatus according to claim 1, wherein the auxiliary member is provided in a plural number, and the discharging member is formed among the plural auxiliary members.

8. The charging apparatus according to claim 1, further comprising an insulating member formed among the plurality of protrusions of the discharging member, and the distal ends of the plurality of protrusions of the discharging member stand back from an end of the insulating member.

9. The charging apparatus according to claim 1, further comprising an insulating member formed among the plurality of protrusions of the discharging member, and wherein c is equal to or greater than 0.8 (mm) where an interval between the distal ends of the plurality of protrusions of the discharging member and the insulating member is denoted as c.

10. The charging apparatus according to any one of claims 1, 2, or 4 to 9, wherein the discharging member is facing a material to be charged and the plurality of protrusions of the discharging member project toward the material to be charged.

11. An image forming apparatus comprising:

image forming means for forming a toner image on a recording material; and charging means for applying chargers to the recording material, the charging means comprising:

a discharging member having a plurality of protrusions; and an auxiliary member for assisting discharges by the discharging member, wherein discharge is made between the discharging member and the auxiliary member upon application of a voltage between the discharging member and the auxiliary member; and wherein P is equal to or greater than D where an interval among distal ends of the plurality of protrusions of the discharging member is denoted as P and an interval between the discharging member and the auxiliary member is denoted as D.

12. The image forming apparatus according to claim 11, wherein the discharging member is an electrode having plural needle portions, and the auxiliary member is an auxiliary electrode.

13. The image forming apparatus according to claim 12, wherein a voltage is fed to the discharging member whereas the auxiliary member is grounded.

14. The image forming apparatus according to claim 11, wherein the discharging member and the auxiliary member are in a plate shape and are faced to each other as being in parallel.

15. The image forming apparatus according to claim 11, wherein D is equal to or greater than V where an interval between the discharging member and the auxiliary member is denoted as D(mm) and a voltage fed between the discharging member and the auxiliary member is denoted as V (kV).

16. The image forming apparatus according to claim 11, wherein D is equal to or greater than 3 (mm).

17. The image forming apparatus according to claim 11, wherein the auxiliary member is provided in a plural number, and the discharging member is formed among the plural auxiliary members.

18. The image forming apparatus according to claim 11, further comprising an insulating member formed among the plurality of protrusions of the discharging member, and the distal ends of the plurality of protrusions of the discharging member stand back from an end of the insulating member.

19. The image forming apparatus according to claim 11, further comprising an insulating member formed among the plurality of protrusions of the discharging member, and wherein c is equal to or greater than 0.8 (mm) where an interval between the distal ends of the plurality of protrusions of the discharging member and the insulating member is denoted as c.

20. The image forming apparatus according to claim 11, wherein the image forming means has a transferring means for transferring the toner image onto the recording material, and the charging means performs removal of charges on the recording material in application of charges to the recording material to which a toner image is transferred with the transferring means.

21. The image forming apparatus according to claim 20, wherein the transferring means is provided in a plural number corresponding to toners in plural different colors.

22. The image forming apparatus according to any one of claims 11, 12, or 14 to 21, wherein the charging means is facing a material to be charted and the plurality of protrusions of the discharging member project toward the material to be charged.

23. A charging apparatus comprising:

a discharging member having a plurality of protrusions;

an insulating member formed among the plurality of protrusions of the discharging member; and an auxiliary member for assisting discharges by the discharging member, wherein the distal ends of the plurality of protrusions of the discharging member stand back from an end of the insulating member.

24. The charging apparatus according to claim 23, wherein the discharging member is an electrode having plural needle portions.

25. The charging apparatus according to claim 23, wherein a voltage is fed to the discharging member whereas the auxiliary member is grounded.

26. The charging apparatus according to claim 23, wherein the discharging member and the auxiliary member are in a plate shape and are faced to each other as being in parallel.

27. The charging apparatus according to claim 23, wherein the auxiliary member is provided in a plural number, and the discharging member is formed among the plural auxiliary members.

28. The charging apparatus according to claim 23, wherein the discharging member is facing a material to be charged and the plurality of protrusions of the discharging member project toward the material to be charged.

29. An image forming apparatus comprising:

image forming means for forming a toner image on a recording material; and charging means for applying charges to the recording material, the charging means comprising:

a discharging member having a plurality of protrusions;

an insulating member formed among the plurality of protrusions of the discharging member; and an auxiliary member for assisting discharges by the discharging member, wherein distal ends of the plurality of protrusions of the discharging member stand back from an end of the insulating member.

30. The image forming apparatus according to claim 29, wherein the discharging member is an electrode having plural needle portions.

31. The charging apparatus according to claim 29, wherein a voltage is fed to the discharging member whereas the auxiliary member is grounded.

32. The charging apparatus according to claim 29, wherein the discharging member and the auxiliary member are in a plate shape and are faced to each other as being in parallel.

33. The charging apparatus according to claim 29, wherein the auxiliary member is provided in a plural number, and the discharging member is formed among the plural auxiliary members.

34. The image forming apparatus according to claim 29, wherein the image forming means has a transferring means for transferring the toner image onto the recording material, and the charging means performs removal of charges on the recording material in application of charges to the recording material to which a toner image is transferred with the transferring means.

35. The image forming apparatus according to claim 34, wherein the transferring means is provided in a plural number corresponding to toners in plural different colors.

36. The image forming apparatus according to claim 29, wherein the charging means is facing a material to be charged and the plurality of protrusions of the discharging member project toward the material to be charged.

37. A charging apparatus comprising:

a discharging member having a plurality of protrusions;

an insulating member formed among the plurality of protrusions of the discharging member, wherein distal ends of the plurality of protrusions of the discharging member stand back from an end of the insulating member; and c is at least 0.8 (mm) where an interval between the distal end of the plurality of protrusions of the discharging member and the insulating member is denoted as c.

38. An image forming apparatus comprising:

image forming means for forming a toner image on a recording material; and charging means for applying charges to the recording material, the charging means comprising:

a discharging member having a plurality of protrusions; and an insulating member formed among the plurality of protrusions of the discharging member, wherein distal ends of the plurality of protrusions of the discharging member stand back from an end of the insulating member, and c is at least 0.8 (mm) where an interval between the distal end of the plurality of protrusions of the discharging member and the insulating member is denoted as c.

* * * * *

UNITED STATES PATENT AND TRADEMARK OFFICE

CERTIFICATE OF CORRECTION

PATENT NO. : 6,952,548 B2
DATED : October 4, 2005
INVENTOR(S) : Michio Uchida et al.

It is certified that error appears in the above-identified patent and that said Letters Patent is hereby corrected as shown below:

Drawings,
Sheet 4, FIG. 4, “bios” should read -- bias --.
Sheet 11. FIG. 11(b), “electrificated” should read -- Electrified --.
Sheet 12, FIG. 12, “to a” should read -- to an --.

Column 1,
Line 19, “men,” should read -- means, --.
Line 23, “applications as” should read -- application. As --.
Line 25, “magenta,” should read -- magenta, and --.
Line 29, “(namely;” should read -- (namely, --.
Line 31, “1*a* and 1*d*” should read -- 1*a* to 1*d* --.
Line 42, “apparatus,” should read -- apparatus --.

Column 2,
Line 3, “drums is” should read -- drums --.
Line 9, “point” should read -- amount --.
Line 50, “rifle” should read -- risks --.

Column 3,
Line 59, “images” should read -- image --.

Column 4,
Line 39, “10, 11” should read -- 10, 11. --.
Line 45, “bolt 7” should read -- belt 7 --.
Line 46, “to a” should read -- to an --.
Line 52, “mean” should read -- means --.

Column 5,
Line 22, “was” should read -- way --.
Line 63, “disc” should read -- discharge --.

Column 6,
Line 8, “28*a*” should read -- 23*a* --.
Line 9, “ “mm ” should read -- “mm” --.
Line 10, the first set of quotation marks “”” should be deleted.
Line 36, “P≧D.” should read -- P≧2D. --.

UNITED STATES PATENT AND TRADEMARK OFFICE

CERTIFICATE OF CORRECTION

PATENT NO. : 6,952,548 B2
DATED : October 4, 2005
INVENTOR(S) : Michio Uchida et al.

It is certified that error appears in the above-identified patent and that said Letters Patent is hereby corrected as shown below:

Column 7,
Line 10, "Accordingly" should read -- Accordingly, --.
Line 26, "electrode 23 insulation spaces 25*a*, 2*b* sand-" should read -- electrode 23. --.
Line 27, "wiched between the needle shape electrode 23." should be deleted.
Line 52, "and 23*a*" should read -- end 23*a* --.
Line 65, "show" should read -- shown -- and "tide" should read -- side --.

Column 8,
Line 6, "about. e.g. 10 mm 50 mm." should read -- about, e.g., 10 mm to 50 mm --.
Line 8, "our" should read -- four --.
Line 48, "-8000V" should read -- -3000V -- and "Corn" should read -- from --.
Line 51, "60 μg" should read -- 60 μA --.

Column 9,
Line 5, "Any" should read -- any --.
Line 8, "structured" should read -- structure --.
Line 46, "electrode 23" should read -- electrode 23, --.

Column 10,
Line 24, "distributed" should read -- disturbed --.
Line 42, "of100 μm" should read -- of 100 μm --.
Line 62, "phosphoreus" should read -- phosphorus --.

Column 11,
Line 14, "and" should read -- and where the image is formed at an environment of low temperature and --.
Line 26, "a-b 1.5 mm," should read -- a-b=1.5mm, --.
Line 44, "he" should read -- the --.
Line 62, "member 27" should read -- member --.

Column 12,
Line 2, "or" should read -- for --.
Line 11, "machines," should read -- machines --.

UNITED STATES PATENT AND TRADEMARK OFFICE

CERTIFICATE OF CORRECTION

PATENT NO. : 6,952,548 B2
DATED : October 4, 2005
INVENTOR(S) : Michio Uchida et al.

It is certified that error appears in the above-identified patent and that said Letters Patent is hereby corrected as shown below:

Column 14,
Line 8, "wherein the" should read -- wherein --.

Signed and Sealed this

Twenty-first Day of March, 2006

JON W. DUDAS
*Director of the United States Patent and Trademark Office*